US006085427A

United States Patent [19]

Persson

[11] Patent Number: 6,085,427

[45] Date of Patent: Jul. 11, 2000

[54] SIGHT

[75] Inventor: Kurt Persson, Köping, Sweden

[73] Assignee: Polarit Försäljnings AB, Koping, Sweden

[21] Appl. No.: 08/836,762

[22] PCT Filed: Nov. 20, 1995

[86] PCT No.: PCT/SE95/01374

§ 371 Date: May 21, 1997

§ 102(e) Date: May 21, 1997

[87] PCT Pub. No.: WO96/17218

PCT Pub. Date: Jun. 6, 1996

[30] Foreign Application Priority Data

Dec. 2, 1994 [SE] Sweden ..... 9404198

[51] Int. Cl.[7] ..... F41G 1/02; F41G 1/30; F41G 1/32

[52] U.S. Cl. ..... 33/241; 33/233; 42/103

[58] Field of Search ..... 33/241, 233, 234, 33/227, 265; 42/100, 103

[56] References Cited

U.S. PATENT DOCUMENTS

| | | | |
|---|---|---|---|
| 3,678,590 | 7/1972 | Hayward | 33/241 |
| 3,820,248 | 6/1974 | Hayward | 33/241 |
| 3,905,708 | 9/1975 | Steck, III | 356/251 |
| 3,912,400 | 10/1975 | Luebkeman | 356/247 |
| 5,836,100 | 11/1998 | Stover | 42/103 |

OTHER PUBLICATIONS

Meadow Industries, Catalog "Products For Better Shooting", "Brite–Site Crossfire–Eliminator".

*Primary Examiner*—Diego Gutierrez
*Assistant Examiner*—R A Smith
*Attorney, Agent, or Firm*—Burns, Doane, Swecker & Mathis, L.L.P.

[57] ABSTRACT

A sight includes an elongated rod-shaped element of light absorbing and light guiding material, and a holding arrangement closely surrounding portions of the rod-shaped element for holding the rod-shaped element. A fastening arrangement is adapted to connect the holding arrangement to a firearm. The holding arrangement includes a first sleeve device, the first sleeve device enclosing an end portion of the rod-shaped element, the first sleeve device being, during operation of the firearm by a shooter, arranged proximate an active eye and a non-active eye of the shooter, a second sleeve device, the second sleeve device enclosing the opposite end portion of the rod-shaped element, and a plurality of thin flange members, the flange members being arranged in a spaced-apart relationship between the sleeve devices.

20 Claims, 2 Drawing Sheets

SIGHT

BACKGROUND AND SUMMARY

The present invention relates to a sight for firearms, comprising an elongate rod-shaped element of light absorbing/light guiding material, preferably acrylic plastic having a fluorescent substance or luminous nylon, a holding means closely surrounding portions of said element for holding this, and a fastening arrangement adapted to connect the holding means to the firearm.

More specifically, the invention is directed to that part of the sight which is to be found adjacent the muzzle of the barrel, i.e. the bead, and is further intended for the type of shooting in which both eyes of the shooter are kept open, such as in skeet shooting.

In shooting, especially in skeet shooting or running deer target shooting, it is important to be able to quickly aim the firearm at a moving target. To facilitate this, the bead should contrast with the background, and it is particularly advantageous if the contrast of the bead with the background is adjusted to the prevailing light conditions. The shooter's eyes, however, must not be dazzled or confused by the bead.

Such a bead is disclosed in U.S. Pat. No. 2,706,335. The bead comprises a rod of fluorescent plastic material in a holder and ambient light is brought into the front end of the rod, and into a portion of the peripheral surface of the rod, and is emitted at the opposite end of the rod, directed towards the sighting shooter. However, light radiates also through said peripheral surface and interferes with the shooter's eye that is not used to sight the firearm.

Thus the object of the invention is to provide a good sight having good contrastability which does not disturb the shooter.

A further object of the invention is to provide a sight which is inexpensive to manufacture and easy to mount.

According to the invention, these objects are achieved by means of a sight which is described in the introductory part and which is characterised in that the holding means comprises a first sleeve device, which encloses an end portion of the rod-shaped element which, during operation of the firearm, is arranged adjacent the shooter's eyes, a second sleeve device enclosing the opposite end portion of the rod-shaped element, and a plurality of thin flange members, which are arranged in a spaced-apart relationship between said sleeve devices.

BRIEF DESCRIPTION OF THE DRAWINGS

A preferred embodiment of the invention will now be described for the purpose of exemplification and with reference to the accompanying drawings, in which.

DETAILED DESCRIPTION

That part of a sight to which the invention is directed to the bead, which is closest to the muzzle of the barrel and which is generally designated 1 in the different figures. The sight is designed so as to fit most firearms, but is preferably adapted to the firearms during the use of which both eyes of the shooter are kept open for quick sighting and firing, e.g. in skeet shooting, running deer target shooting and the like. The sight is usable for pistols, revolvers, guns, sporting rifles etc. and is especially usable for shotguns.

Figure 1:
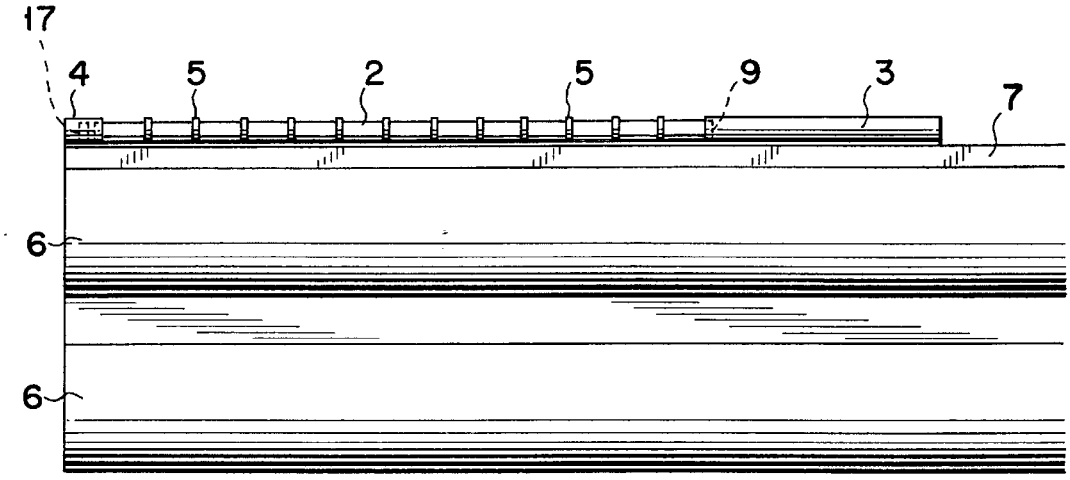
FIG. 1 is a side view of one embodiment of the inventive sight, mounted on a firearm.

With reference to FIG. 1, the sight 1 (bead) comprises an elongate rod-shaped element 2 of light absorbing/light guiding material, such as acrylic plastic with an added fluorescent substance, luminous nylon (nylon having luminescence), glass of the optical fibre type and the like, of an optical colour, although red is preferred. The rod-shaped element 2 preferably is of circular cross-section, but may be of an optional cross-section, if desired. In the preferred embodiment, the circumferential surface of the element 2 is coated with a surface layer having a refractive index such that ambient light absorbed through the circumferential surface is substantially completely reflected inside the element (mirrored) and is emitted through a non-coated end face 9 of the element—the end face closest to the (sighting) shooter according to the embodiment in FIGS. 1–3, and the end face furthest away from the shooter according to the embodiment in FIGS. 5–8. However, a certain flow of light from the circumferential surface will appear, and this flow of light is screened off for the shooter's non-sighting eye by means of the inventive sight 1.

Referring once more to FIG. 1, the sight 1 comprises a holding means 3–5 which closely surrounds portions of the rod-shaped element 2 for holding and screening off the same. Thus, the holding means consists of a first elongate sleeve device 3, which encloses said end face 9 of the element 2 at a distance from the free end of the sleeve device 3. Consequently, said sleeve device is substantially empty and is of a length that is sufficient to screen off the light emitted from the end, such that only the active (sighting) eye of the shooter receives this; cf. FIG. 4. The inside of the sleeve device is suitably provided with a blooming coat. A second sleeve device 4, which preferably is shorter than the first sleeve device 3, encloses the opposite end of the rod-shaped element. A plurality of thin flange members 5 are arranged at a distance from each other between the sleeve devices 3 and 4 and are spaced from these. Also the flange members 5 closely surround portions of the element 2 and screen off the intermediate, uncovered portions of the element 2 for the shooter's nonactive eye, in the embodiment presented the left eye of a right-shooter (the shooter aligns the firearm by means of his right eye); cf. FIG. 2 which shows the sight as regarded by the left eye of the right-shooter, and FIG. 3 which shows the sight as regarded by the right eye of the right-shooter.

FIG. 1 shows that the flange members 5 have an outer diameter conforming to that of the sleeve devices, which is preferred from the point of view of production, but they can, of course, also have a greater outer circumference, whereby a smaller number is required for screening off. Moreover, the flange members 5 are equidistantly spaced from each other, but they may be arranged in any desirable manner, e.g. they can be mutually spaced apart a distance that increases linearly from the first sleeve device 3 towards the second sleeve device 4. The sleeve devices 3 and 4 and the flange members 5 can be arranged separately or be joined to each other by means of a joining piece of material (not shown), in which case the entire holding means 3–5 can be cut from one and the same piece of pipe. The rod-shaped element 2 is preferably glued to the holding means, but can also be arranged with a press fit or the like so as to permit the element to be replaced.

The inventive sight thus absorbs light emission from the ambience through its circumferential surface and guides the light to an end face 9, such that the luminous end face contrasts with the background and helps the shooter align the firearm. Thus it is important to optimise the brought-in light, and this means that the flange members 5 should be thin so as to reduce the size of those portions of the circumferential surface which they cover. Since the light is damped with the length of the rod-shaped element 2, there is an optimum length for the element. One of the important advantages of the rod is that is has a passive light-controlling function. The more ambient light the stronger light spot, and vice versa in case of weaker ambient light. In practical tests, the sight has been found to function in an excellent manner, and one of the great advantages is that, by means of this sight, the shooter can use both eyes simultaneously, focus them on the object and all the time have the light spot in the field of vision. It is also possible to provide the second sleeve device 4 with a mirror device 17, or provide the end of the element 2 in this sleeve device with a reflective coating so as to increase the flow of light at the end face 9, when necessary.

Figure 3:
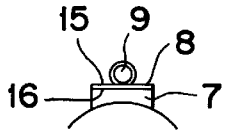
FIG. 3 illustrates the sight in FIG. 1, as regarded by the right eye of a right-shooter.
Figure 4:
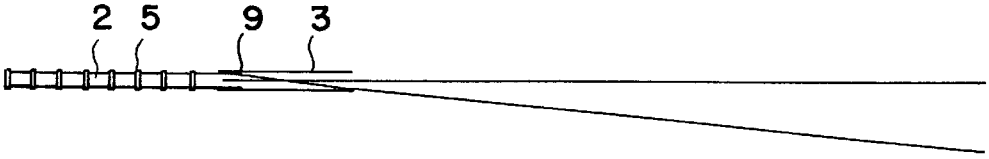
FIG. 4 illustrates the scattering of light at the active end of the sight according to FIG. 1.

Reference is now made especially to FIGS. 1 and 3, which illustrate the fastening arrangement of the sight according to the preferred embodiment. The fastening arrangement is adapted to connect the holding means 3–5 to the firearm, which is schematically illustrated in the form of a shotgun, the muzzles of the barrels 6 being illustrated only. On top of the uppermost barrel a bar 7 is arranged, and the fastening arrangement is adapted to be fixed to this bar. The fastening arrangement comprises a strip-shaped member 8, which preferably is made of the same material as the holding means 3–5 and preferably is of such a thickness as to be flexible. Moreover, the member 8 preferably is of substantially the same length as the total length of the holding means 3–5, and a width greater than that of the holding means. The holding means can, in some suitable manner, for instance by gluing, soldering or brazing, be attached to the member 8 or be integrated therewith. One side (major face) 15 of the member 8 thus supports the holding means, and its opposite side (major face) 16 is adapted to be attached to the bar 7 of the firearm e.g. by means of an adhesive. Thus, the sight can be marketed together with a double-adhesive tape attached thereto, thereby allowing the buyer himself to stick the sight on, or the sight can be attached by means of screw joints, soldering, brazing, gluing etc. Alternatively, the member 8 can be mounted on an adapter or a telescope mounting which is adapted to engage the firearm mounting for a telescope sight (not shown). It may be convenient to use a nonyielding member 8 instead of a flexible one if the length of the member is greater than that of the adapter or mounting.

Figure 2:
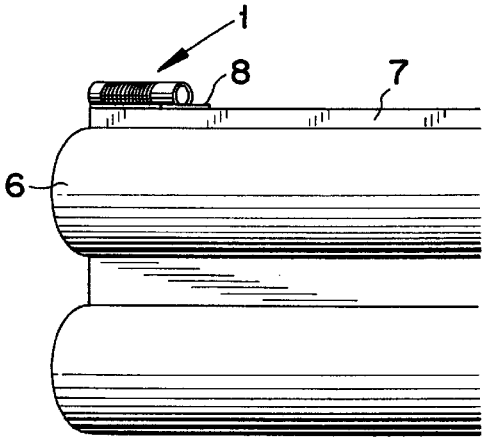
FIG. 2 illustrates the sight in FIG. 1, as regarded by the left eye of a right-shooter.
Figure 5:
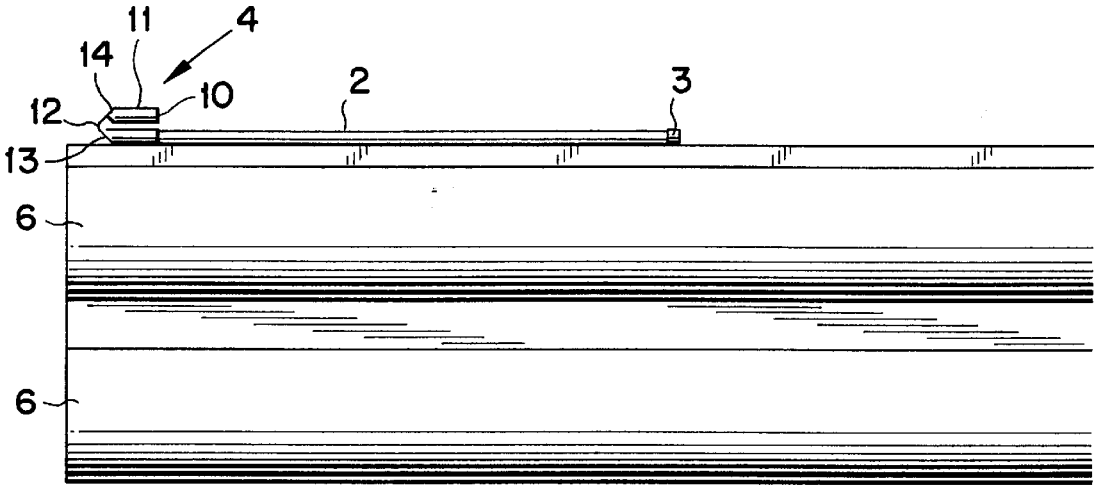
FIG. 5 is a schematic side view of a second embodiment of the invention, mounted on a firearm.
Figure 6:
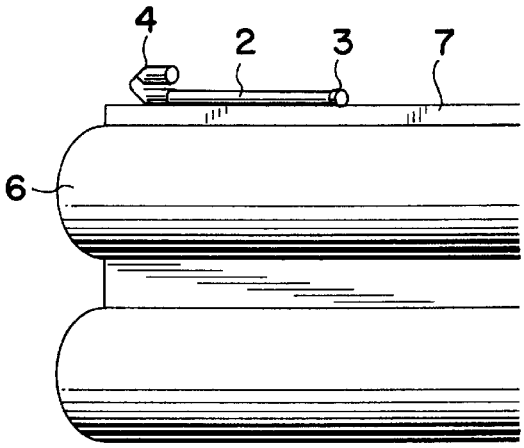
FIG. 6 shows the sight in FIG. 5 as regarded by the left eye of a right-shooter.
Figure 7:
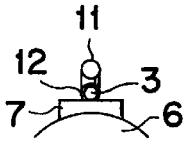
FIG. 7 shows the sight in FIG. 5 as regarded by the right eye of a right-shooter.
Figure 8:
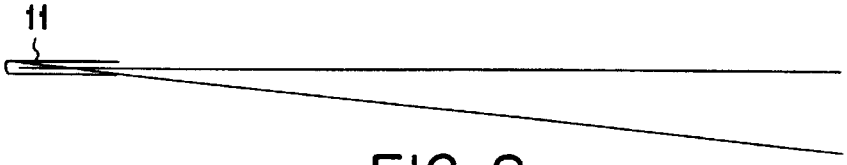
FIG. 8 illustrates the scattering of light at the active end of the sight according to FIG. 5.

In FIGS. 5–8, a further embodiment of the invention is shown. This embodiment differs from the one previously presented mainly by the end of the rod-shaped element 2 adjacent the (sighting) shooter being blocked and not emitting any light, which, however, the end of the element adjacent the muzzle of the barrel does. The second sleeve device 4 is here substantially U-shaped, the first leg 10 of the U-shape being arranged in an enclosing manner on the light-emitting end of the rod-shaped element 2, and its second leg 11 being oriented in a plane extending through the rod-shaped element 2 and the barrel (barrels) of the firearm, i.e. perpendicular to the member 8. The arcuate portion 12 of the sleeve device 4 between the legs 10 and 11 comprises reflective means which transmits the light from the first leg 10 (from the end face of the element 2) to the second leg 11. The reflective means can be a prism or a pair of mirrors 13 and 14 as indicated in FIG. 5. The length of the second (upper) leg 11 is sufficient to screen off the light emitted from the end of the leg, such that only the active (sighting) eye of the shooter can see this, cf. FIG. 8, and the inside of said leg is suitably provided with a blooming coat. FIG. 6 illustrates the sight (bead) 1 as regarded by the left eye of a right-shooter, and FIG. 7 shows the sight as regarded by the right eye of a right-shooter. The sight also comprises flange members and a fastening arrangement, which are suitably designed in the same way as in the embodiment presented above (FIGS. 1–3). Also the rod-shaped element is preferably designed as stated above.

The invention is not restricted to that described above and shown in the drawings and can be modified within the scope of the appended claims.

I claim:

1. A sight for firearms, comprising:

an elongated rod-shaped element of light absorbing and light guiding material;

a holding arrangement closely surrounding portion of the rod-shaped element for holding the rod-shaped element; and a fastening arrangement adapted to connect the holding arrangement to a firearm;

the holding arrangement including a first sleeve device, the first sleeve device enclosing an end portion of the rod-shaped element, the first sleeve device being, during operation of the firearm by a shooter, arranged proximate an active eye and a non-active eye of the shooter, a second sleeve device, the second sleeve device enclosing the opposite end portion of the rod-shaped element, and a plurality of thin flange members, the flange members being arranged in a spaced-apart relationship between the sleeve devices such that light reflected by a peripheral surface of the rod-shaped element is directed away from the non-active eye of the shooter.

2. The sight as claimed in claim 1, wherein the flange members are equidistantly spaced from each other.

3. The sight as claimed in claim 2, wherein outer diameters of the flange members are equal to outer diameters of the sleeve devices.

4. The sight as claimed in claim 3, wherein the rod-shaped element is exchangeably arranged in the holding arrangement.

5. The sight as claimed in claim 2, wherein the rod-shaped element is exchangeably arranged in the holding arrangement.

6. The sight as claimed in claim 2, wherein a length of the second sleeve device is less than a length of the first sleeve device.

7. The sight as claimed in claim 2, wherein the fastening arrangement includes a strip-shaped member, the strip-shaped member being substantially as long as a total length of the holding arrangement, the strip-shaped member having a width greater than that of the holding means, a first major face of the strip-shaped member being fixedly connected to the holding arrangement, and a second major face of the strip-shaped member being attachable to the firearm.

8. The sight as claimed in claim 1, wherein the flange members are mutually spaced apart a distance that increases linearly from the first sleeve device towards the second sleeve device.

9. The sight as claimed in claim 8, wherein outer diameters of the flange members are equal to outer diameters of the sleeve devices.

10. The sight as claimed in claim 9, wherein the rod-shaped element is exchangeably arranged in the holding arrangement.

11. The sight is claimed in claim 8, wherein the rod-shaped element is exchangeably arranged in the holding arrangement.

12. The sight as claimed in claim 1, wherein outer diameters of the flange members are equal to outer diameters of the sleeve devices.

13. The sight as claimed in claim 12, wherein the rod-shaped element is exchangeably arranged in the holding arrangement.

14. The sight as claimed in claim 1, wherein the rod-shaped element is exchangeably arranged in the holding arrangement.

15. The sight as claimed in claim 1, wherein a length of the second sleeve device is less than a length of the first sleeve device.

16. The sight as claimed in claim 1, wherein the fastening arrangement includes a strip-shaped member, the strip-shaped member being substantially as long as a total length of the holding arrangement, the strip-shaped member having a width greater than that of the holding arrangement, a first major face of the strip-shaped member being fixedly connected to the holding arrangement, and a second major face of the strip-shaped member being attachable to the firearm.

17. The sight as claimed in claim 16, wherein the strip-shaped member is non-yielding, and is attached to the firearm by an adapter that engages a firearm mounting for a telescope sight.

18. A sight for firearms, comprising:

an elongated rod-shaped element of light absorbing and light guiding material;

a holding arrangement closely surrounding portions of the rod-shaped element for holding the rod-shaped element; and a fastening arrangement adapted to connect the holding arrangement to a firearm;

the holding arrangement including a first sleeve device, the first sleeve device enclosing an end portion of the rod-shaped element, the first sleeve device being, during operation of the firearm by a shooter, arranged proximate eyes of the shooter, a second sleeve device, the second sleeve device enclosing the opposite end portion of the rod-shaped element, and a plurality of thin flange members, the flange members being arranged in a spaced-apart relationship between the sleeve devices, wherein the second sleeve device is substantially U-shaped, a first leg of the second sleeve device being arranged in an enclosing manner on a light-emitting end of the rod-shaped element and a second leg of the second sleeve device being adapted to be oriented in a plane extending through a center of the rod-shaped element and at least one barrel of the firearm.

19. The sight as claimed in claim 18, wherein an arcuate portion of the second sleeve device includes a reflector that transmit light from the first leg to the second leg.

20. A sight for firearms, comprising:

an elongated rod-shaped element of light absorbing and light guiding material;

a holding arrangement closely surrounding portions of the rod-shaped element for holding the rod-shaped element; and a fastening arrangement adapted to connect the holding arrangement to a firearm;

the holding arrangement including a first sleeve device, the first sleeve device enclosing an end portion of the rod-shaped element, the first sleeve device being, during operation of the firearm by a shooter, arranged proximate eyes of the shooter, a second sleeve device, the second sleeve device enclosing the opposite end portion of the rod-shaped element, and a plurality of thin flange members, the flange members being arranged in a spaced-apart relationship between the sleeve devices, wherein the flange members are equidistantly spaced from each other, and wherein the second sleeve device is substantially U-shaped, a first leg of the second sleeve device being arranged in an enclosing manner on a light-emitting end of the rod-shaped element and a second leg of the second sleeve device being adapted to be oriented in a plane extending through a center of the rod-shaped element and at least one barrel of the firearm.

* * * * *